United States Patent [19]

McCullough, Jr. et al.

[11] Patent Number: 4,956,235

[45] Date of Patent: Sep. 11, 1990

[54] CARBONACEOUS FIBER OR FIBER ASSEMBLY WITH INORGANIC COATING

[75] Inventors: Francis P. McCullough, Jr.; Steven L. Brewster, both of Lake Jackson; R. Vernon Snelgrove, Damon, all of Tex.; George C. Higgins, Midland, Mich.

[73] Assignee: The Dow Chemical Company, Midland, Mich.

[21] Appl. No.: 366,809

[22] Filed: Jun. 14, 1989

Related U.S. Application Data

[62] Division of Ser. No. 163,919, Mar. 4, 1988, Pat. No. 4,902,563.

[51] Int. Cl.[5] ..... B32B 9/00; D02G 3/00; D02G 1/00

[52] U.S. Cl. ..... 428/368; 428/367; 428/369; 428/371; 428/408

[58] Field of Search ..... 428/375, 408, 367, 386; 423/447.1, 447.2, 447.6, 447.4

[56] References Cited

U.S. PATENT DOCUMENTS

| | | | |
|---|---|---|---|
| 4,460,650 | 7/1984 | Ogawa et al. | 428/389 |
| 4,761,323 | 8/1988 | Mühlratzer et al. . | |
| 4,766,013 | 8/1988 | Warren . | |
| 4,788,104 | 11/1988 | Adrainsen et al. | 428/288 |

FOREIGN PATENT DOCUMENTS 0199567 10/1986 European Pat. Off. .

*Primary Examiner*—George F. Lesmes
*Assistant Examiner*—J. M. Gray

[57] ABSTRACT

A thermally stable ceramic coated carbonaceous fiber batting, fiber tow, yarn or fabric which maintains loft, has some degree of resiliency and some degree of stability in the presence of various concentrations of oxygen at elevated temperatures said fibers having a reversible deflection ratio of greater than 1.2:1 and an aspect ratio greater than 10:1.

10 Claims, 1 Drawing Sheet

CARBONACEOUS FIBER OR FIBER ASSEMBLY WITH INORGANIC COATING

This is a divisional of application Ser. No. 163,919, filed Mar. 4, 1988, now U.S. Pat. No. 4,902,563.

FIELD OF THE INVENTION

This invention relates to thermally stable and resilient coated fibers, yarn and fabric structures. More particularly, this invention relates to a coated fibrous structure comprising a carbonaceous fiber or fiber assembly coated with a ceramic and/or metallic coating which is useful as insulation at high temperatures.

The structures of the invention are particularly suitable for use in lieu of ceramic or metallic structures as filters or as insulating materials. Also, the structures are useful in the manufacture of electric motors. That is, the ceramic and/or metallic structures can be used for the motor's windings or the armature of the motor.

BACKGROUND OF THE INVENTION

Many high temperature applications require a material that is not only processable into a fibrous structure but is also capable of withstanding severe end-use temperatures. In some instances, these temperatures may be as high as 1000 degrees C to 2000 degrees C. The existing engineering plastics cannot be used in such applications because most plastics decompose below 1000 degrees C. Moreover, such plastics suffer dramatic losses in mechanical properties such as tensile strength and tenacity at temperatures as low as 250–400 degrees C. For example, KEVLAR 29 (a trademark of DuPont), when heated to 250 degrees C in air can lose 60% of its tenacity and 60% of its tensile strength. At 425 degrees C Kevlar irreversible degradation and at 500 degrees C KEVLAR decomposes. NOMEX (a trademark of DuPont) decomposes at 370 degrees C and polybenzyimidazole (PBI) decomposes at 480 degrees C. At 520 degrees C, the carbonaceous fibers of the present invention, retain 90% of their original weight.

Heretofore, ceramic graphite fiber and quartz battings and fabrics have been used for high temperature thermal insulation and high temperature protection. All of these prior art materials are very brittle and tend to pack with time and lose loft, thus losing performance with time. The quartz and ceramic materials are air stable at high temperatures such as greater than 450 degrees C. However, they are very difficult for workers to handle and present health risks to the workers similar to those problems created by handling asbestos. A significant amount of research has been conducted by industry to find fibrous materials which can be readily processed into textile batting structures or fabrics and which will withstand temperatures of 400 degrees C or greater in air without loss of mechanical properties. These fibers include Celanese's PBI and Oxidized Polyacrylonitrile Fiber. While these materials are readily processable and have a high degree of resiliency, they lack the requisite thermal stability to withstand temperatures of greater than 400 degrees C and still maintain good mechanical properties.

SUMMARY OF THE INVENTION

The present invention is directed to an oxygen and thermally stable flexible structure comprising carbonaceous fibers coated with a ceramic and/or metal coating, said carbonaceous fiber comprising a resilient, shape reforming, elongatable, non-linear, non-flammable carbonaceous fiber having a reversible deflection ratio of greater than 1.2:1 and an aspect ratio greater than 10:1. The fiber structure may be woven or non-woven, coated with a ceramic layer or metal layer alone or the ceramic layer may also carry a metal layer.

In accordance with one embodiment of the invention, the coating is found primarily on the outside surfaces of the structure. The surface coated structure has good resiliency and shape reforming compressibility. Such structures are useful where surface abrasion may occur and temperatures are relatively low.

In accordance with a further embodiment of the invention the structure is at least 90% coated, having a carbon content of at least 85%. The structure is useful as furnace and turbine linings.

DETAILED DESCRIPTION OF THE PREFERRED EMBODIMENTS

Figure 1:
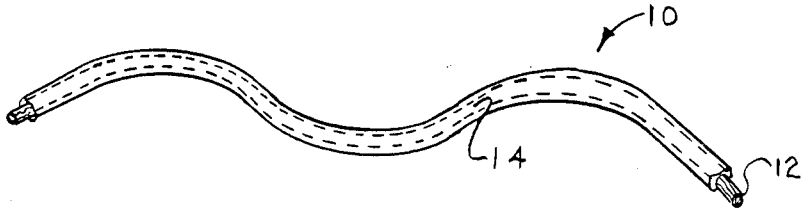
FIG. 1 is a perspective view of a coated filament of the invention with a sinusoidal configuration which can be used to form windings for an electric motor.

In accordance with the present invention a ceramic and/or metallic coating is formed on a fibrous substrate such as a fiber or filament per se or a fiber assembly, i.e., a plurality of fibers or filaments such as in the form of a mat, batting, bale, yarn or fabric. The coated fibrous substrate may advantageously be used in oxidation conditions and at high temperature application wherein uncoated fiber substrates could otherwise not be used satisfactorily.

The ceramic materials which can be utilized in the present invention comprises the oxides or mixtures of oxides, of one or more of the following elements: magnesium, calcium, strontium, barium, aluminum, scandium, yttrium, the lanthanides, the actinides, gallium, indium, thallium, silicon, titanium, zirconium, hafnium, thorium, germanium, tin, lead, vanadium, niobium, tantalum, chromium, molybdenum, tungsten, and uranium. Compounds such as the carbides, borides and silicates of the transition metals may also be used. Other suitable ceramic materials which may be used are zircon-mullite, mullite, alpha alumina, sillimanite, magnesium silicates, zircon, petalite, spodumene, cordierite and alumino-silicates. Suitable proprietary products are "MATTECEL" (Trade Name) supplied by Matthey Bishop, Inc., "TORVEX" (Registered Trademark) sold by E.I. du Pont de Nemours & Co., "WI" (Trade Name) sold by Corning Glass and "THERMACOMB" (Registered Trademark) sold by the American Lava Corporation. Another useful product is described in British Patent No. 882,484.

Other suitable active refractory metal oxides include for example, active or calcined beryllia, baria, alumina, titania, hafnia, thoria, zirconia, magnesia or silica, and combination of metal oxides such as boria-alumina or silica-alumina. Preferably the active refractory oxide is composed predominantly or oxides of one or more metals of Groups II, III and IV of the Periodic Table.

Among the preferred compounds may be mentioned YC, $TiB_2$, $HfB_2$, $VB_2$, VC, VN, $NbB_2$, NbN, $TaB_2$, $CrB_2$, $MoB_2$ and $W_2B$.

Preferably, the coating formed on the surface of the fibrous substrate of the present invention are selected from oxides such as $TiO_2$; nitrides such as BN; carbides such as BC and TiC; borides such as $TiB_2$ and TiB; metals for example Ni, Au, and Ti; and the like.

Any conventional method of forming the coating on the fibrous substrate may be used. For example, a chemical vapor deposition can be used. The substrate can be dipped into a coating solution to form the coating. Brushing a coating solution on a substrate can also be used. Spraying a coating solution onto a substrate can also be used.

The thickness and amount of coating applied to the fibrous substrate should be sufficient such that the surface coating substantially insulates the fibrous substrate from the oxygen-containing atmosphere, i.e., such that the coating exposed to the oxygen-containing atmosphere protects the fibrous substrate from oxidation. The thickness and amount of coating on the substrate will depend on the form in which the substrate is used and the desired application for which the substrate will be used. For example, the coating thickness may vary which will depend on whether the substrate is a single fiber which may have a coating thickness of about 1 micron; a tow of fiber which may have a coating thickness of about 10–25 microns; and a batting of fibrous material which may have a thickness of about 10–100 microns.

As shown in FIG. 1, a coated fiber 10 having an electrically conductive sinusoidal carbonaceous fiber 12 and a metallic outer coat 14 may be prepared which is useful as a lightweight winding for an electric motor.

Figure 2:
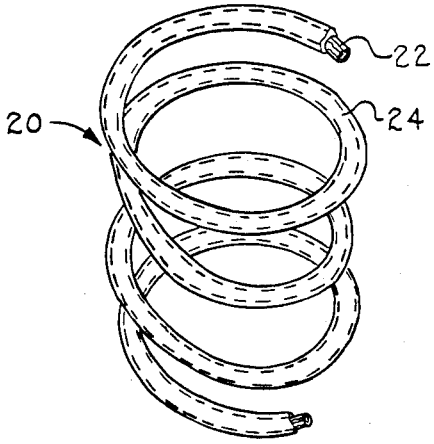
FIG. 2 is a perspective view of a coated filament cf the invention with a coil-like configuration.

In FIG. 2 a coil-like coated fiber 20 is illustrated having a ceramic coating 24 and a coil-like fiber 22.

Figure 3:
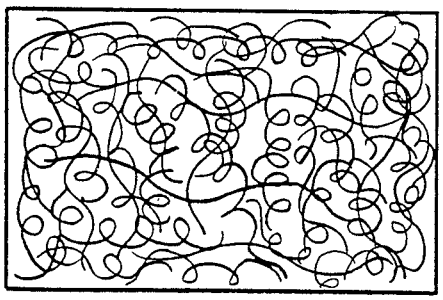
FIG. 3 is a cross-sectional and enlarged view of a lightweight non-woven fibrous structure with an inorganic coating as one embodiment of the invention.

FIG. 3 shows a needle-punched felt-like batting having a ceramic coating which is suitable as a light weight insulation.

The fibers utilized for the fibrous substrate of the present invention, herein referred to as "carbonaceous fibers" have a carbon content of at least 65% and their method of preparation are, preferably, those described in U.S. patent application Ser. No. 856,305, entitled "Carbonaceous Fibers with Spring-Like Reversible Reflection and Method of Manufacture," filed 4-28-86, by McCullough et al.; incorporated herein by reference and as described in U.S. patent application Ser. No. 918,738, entitled "Sound and Thermal Insulation," filed, 10-14-86, by McCullough et al.; incorporated herein by reference.

The carbonaceous fibers comprise non-linear, nonflammable resilient elongatable carbonaceous fibers having a reversible deflection ratio of greater than about 1.2:1 and an aspect ratio (l/d) of greater than 10:1. The carbonaceous fibers may possess a sinusoidal or coil-like configuration or a more complicated structural combination of the two. Preferably, the carbonaceous fibers used are sinusoidal in configuration.

Preferably, the carbonaceous fibers have a LOI value greater than 40 when the fibers are tested according to the test method of ASTM D 2863-77. The test method is also known as "oxygen index" or "limited oxygen index" (LOI). With this procedure the concentration of oxygen in $O_2/N_2$ mixtures is determined at which a vertically mounted specimen-ignited at its upper end and just (barely) continues to burn. The width of the specimen is 0.65 to 0.3 cm with a length of from 7 to 15 cm. The LOI value is calculated according to the equation:

$$LOI = \frac{[O_2]}{[O_2] + [N_2]} \times 100$$

The carbonaceous fibers are prepared by heat treating a suitable stabilized precursor material such as polymeric materials which can be made into a non-linear fiber or filament structures or configurations and are thermally stable. A suitable stabilized precursor material may be, for example, a material derived from stabilized polyacrylonitrile based materials or stabilized pitch (petroleum or coal tar) based materials. Preferably, the pretreated stabilized precursor material used in the present invention is derived from stabilized acrylic based filaments.

The precursor stabilized acrylic filaments which are advantageously utilized in preparing the carbonaceous fibers used in the fibrous structures of the present invention are selected from the group consisting of acrylonitrile hompolymers, acrylonitrile copolymers and acrylonitrile terpolymers. The copolymers preferably contain at least about 85 mole percent of acrylonitrile units and up to 15 mole percent of one or more monovinyl units copolymerized with styrene, methylacrylate, methyl methacrylate, vinyl chloride, vinylidene chloride, vinyl pyridine, and the like. Also, the acrylic filaments may comprise terpolymers, preferably, wherein the acrylonitrile units are at least about 85 mole percent.

The preferred precursor materials are in the form of a monofilament fiber or plurality of fibers such as a tow yarn, woven cloth or fabric, or knitted cloth which are prepared by any of a number of commercially available techniques. The precursor material is heated to a temperature above about 525 degrees C., preferably to above about 550 degrees C and thereafter deknitted and carded to produce a fluff of the carbonaceous fibers which can be laid up in a batting-like form.

As one embodiment of the present invention and not to be limited thereby, the invention may be described with reference to polyacrylonitrile based fibers. For example, in the case of polyacrylonitrile (PAN) based fibers, the PAN based fibers are formed by convention1 methods such as by melt or wet spinning a suitable fluid of the precursor material. The PAN based fibers which have a normal nominal diameter of from about 4 to 25 micrometers are collected as an assembly of a multiplicity of continuous filaments in tows. The PAN based fibers are then stabilized, for example by oxidation or any other conventional method of stabilization in the conventional manner. The stabilized tows (or staple yarn made from chopped or stretch broken fiber staple) are thereafter, in accordance with the present invention, formed into a non-linear sinusoidal form by knitting the tow or yarn into a fabric or cloth, recognizing that other shape forming methods, such as crimping and coil forming, combined with thermosetting, can be employed to produce the non-linear shape.

In the above embodiment, the so-formed knitted fabric or cloth is thereafter heat treated, in a relaxed and unstressed condition, at a temperature of from about 525 to 750 degrees C, in an inert atmosphere for a period of time to produce a heat induced thermoset reaction wherein additional crosslinking and/or a cross-chain cyclization reaction occurs between the original polymer chain. At a lower temperature range of from about 150 to about 525 degrees C, the fibers are provided with a varying proportion of temporary to permanent set, while in an upper range of temperatures of from 525 degrees C and above, the fibers are provided with a permanent set. The heat treated fabric or cloth may be deknitted, if desired, to produce a tow or yarn containing the non-linear fibers.

Specifically, what is meant by permanently set is that the fibers possess a degree of irreversibility. It is of course to be understood that the fiber or fiber assembly may be initially heat treated at the higher range of temperatures so long as the heat treatment is conducted while the non-linear configuration, such as coil-like and/or sinusoidal configuration, is in a relaxed or unstressed state and under an inert, non-oxidizing atmosphere.

As a result of the higher temperature treatment of 525 degrees C and above, a permanently set sinusoidal (as illustrated in FIG. 1) or coil-like (as illustrated in FIG. 2) configuration or structure is imparted to the fibers in yarns, tows or threads. The resulting fibers, tows or yarns having the non-linear structural configuration may be used per se or opened to form a wool-like fluff. A number of methods known in the art can be used to create an opening, a procedure in which the yarn, tow or the fibers or filaments of the cloth are separated into a non-linear, entangled, wool-like fluffy material in which the individual fibers retain their coil-like or sinusoidal configuration yielding a fluff or batting-like body of considerable loft.

The stabilized fibers permanently are configured into a desired structural configuration, by knitting, and thereafter heating at a temperature of greater than about 550 degrees C retain their resilient and reversible deflection characteristics. It is to be understood that higher temperatures may be employed of up to about 1500 degrees C, but the most flexible and smallest loss of fibers breakage, when carded to produce the fluff, is found in those fibers and/or filaments heat treated to a temperature from about 525 and 750 degrees C.

It is to be further understood that carbonaceous precursor starting materials may have imparted to them an electrically conductive property on the order of that of metallic conductors by heating the fiber fluff or the batting like shaped material to a temperature above about 1000 degrees C in a non-oxidizing atmosphere. The electroconductive property may be obtained from selected starting materials such as pitch (petroleum or coal tar), polyacetylene, acrylonitrile based materials, e.g., a polyacrylonitrile copolymer (PANOX or GRAFIL-01), polyphenylene, polyvinylidene chloride resin (SARAN, trademark of The Dow Chemical Company) and the like.

The carbonaceous fiber material which is utilized in the fibrous structures of this invention may be classified into three groups depending upon the particular use and the environment that the structures in which they are incorporated are placed.

In a first group, the non-flammable non-linear carbonaceous fibers are non-electrically conductive and possess no anti-static characteristics.

The term non-electrically conductive as utilized in the present invention relates to a resistance of greater than $10^7$ ohms per inch on a 6K tow formed from precursor fibers having a diameter of about 7 to 20 microns.

When the precursor fiber is an acrylic fiber it has been found that a nitrogen content of 18.8% or more results in a non-conductive fiber.

In a second group, the non-flammable non-linear carbonaceous fibers are classified as being partially electrically conductive (i.e., having a low conductivity) and have a carbon content of less than 85%. Low conductivity means that a 6K tow of fibers has a resistance of about $10^7$ to $10^4$ ohms per inch. Preferably, the carbonaceous fibers are derived from stabilized acrylic fibers and possesses a percentage nitrogen content of from about 16 to 22% for the case of a copolymer acrylic fiber, more preferably from about 16 to 18.8%, and up to about a maximum content of about 35% for a terpolymer acrylic fiber.

In a third group are the fibers having a carbon content of at least 85%. These fibers are characterized as being highly conductive. That is, the resistance is less than $10^4$ ohms per inch and are useful in applications where electrical grounding or shielding are also desired.

The carbonaceous fibrous substrate of this invention may be used in substantially any desired fabricated form which will depend on the purpose for which the structure is to be used.

In one embodiment, the substrate may be the original thermally set knitted fabric containing the non-linear carbonaceous fibers.

In another embodiment of this invention, the substrate may include the individual non-linear carbonaceous fibers in the form of long or short fibers. The carbonaceous fibers generally can be from about 0.125 to about 4 inches in length.

In still another embodiment, the substrate may be non-linear carbonaceous fibers used in the form of a fiber assembly such as a yarn or tow composed of many filaments.

In still another embodiment the substrate may be the carbonaceous fibers fabricated formed into a knitted cloth, for example, plain jersey knit, interlock, ribbed, cross float jersey knit or weft knit, and the like, or woven into a fabric, for example of plain weave, satin weave, twill weave, basket weave, and the like. The woven fabric may combine the non-linear carbonaceous fibers of the present invention, for example as warp.

The fiber assembly may also be in the form of a non-woven material or fabric such as a mat, fluff or batting of fibers such as described above. In another embodiment the composite may include the wool-like fluffy material produced from the thermally set knitted fabric which contains the non-linear fiber. The substrate in the form of a batting or wool-like fluff may be prepared by conventional needle-punching means.

The coated fibrous structures of the present invention may be used in applications wherein the temperature ranges from about 400 degrees C and above and in oxygen-containing atmospheres such as air. Application wherein the coated insulation is particularly useful include high temperature insulation and high temperature filtration.

The present invention is further illustrated by the following examples, but is not to be limited thereby. The amounts shown are all in percent by weight.

EXAMPLE 1

A piece of cloth (plain jersey) from tows (6K) of PANOX OPF (oxidized PAN fiber) was heat treated to at a maximum temperature of 900 degrees C to form the carbonaceous fibrous substrate of this invention. A single tow of carbonaceous fiber was deknitted from the fibrous substrate fabric and weighed.

A 25 gram sample of ground boric acid was mixed with 25 grams of ground urea. The solid mixture was heated to 143 degrees C to form a boiling syrup-like mixture. The hot liquid was dissolved in 300 ml of hot (80 degrees C) de-ionized water. The solution cooled with no precipitate observed.

Ten milliliters of the boric acid/urea solution were poured into an aluminum weighing pan. The tow of carbonaceous fiber was placed in the solution and thoroughly wetted, then dried in air at 120 degrees C for one hour. After cooling for one hour, the resultant coated carbonaceous fiber tow was reweighed.

The coated tow was placed in a quartz tube (44 inch long and 2¼ inch I.D.) which was sealed save for a purge gas inlet at one end of the tube and a corresponding outlet at its opposite end. An electric tube furnace was used to heat the tow to 1000 degrees C while purging with nitrogen. After 1 hour at 1000 degrees C, the furnace was de-energized and the tow was cooled to room temperature in nitrogen. One hour after removal from the quartz tube, the tow was reweighed. The carbonaceous fiber tow, possessed a thin layer of boron nitride (BN) covalently bonded to its surface.

The BN-coated tow was returned to the quartz tube/-furnace. A single uncoated tow of carbonaceous fiber deknitted from the fabric above was also placed in the quartz tube/furnace. The nitrogen purge was disconnected from the quartz tube and replaced with an air (plant air) purge. Air flow rate was regulated at 2.55 SCFH (10 psig, 70 degrees F) with a roto-meter. Such an air flow provides sufficient oxygen to completely oxidize 6 grams of carbonaceous fiber in 2 hours at 600 degrees C or 1 hour at 700 degrees C. If more than 6 grams of carbonaceous fiber (not counting the coating weight) are placed in the tube furnace, air flow rate and/or reaction time may have to be adjusted accordingly in order to achieve complete oxidation of uncoated carbonaceous fiber.

The tube-furnace was energized and heated to 600 degrees C, maintained at 600 degrees C for 2 hours, and then de-energized. The samples were cooled to room temperature in air. When the samples were cool, the samples were attempted to be removed from the quartz tube. The tow of carbonaceous fiber which contained no coating was reduced to white ash and could not be removed from the furnace and weighed. The BN-coated tow appeared unaltered and was removed from the furnace with ease. After one hour, the BN-coated tow was weighed which revealed that 91 percent cf the cured weight of the BN-coated tow remained.

The structure is suitable for use as a furnace filter.

EXAMPLE 2

A piece of cloth knitted (plain jersey) from tows (6K) of OPF was heat treated at a maximum temperature of 900 degrees C to form a carbonaceous fiber of the present invention. A specimen of cloth weighing 1.308 gram was removed from the larger sample of cloth.

Six grams of Graphi-Coat 623 base, obtained from Aremco Products, Inc., were mixed with 4 grams of Graphi-Coat 623 Activator to produce a coating mixture.

The carbonaceous fiber cloth specimen was placed in the coating mixture and a paint brush was used to thoroughly coat the specimen on both sides, along the edges and in the open areas of the knit. After coating, the specimen was removed from the mixture and placed on a flat surface. Using a glass rod excess coating mixture was pressed from the specimen. After drying in air at 120 degrees C for one hour and then cooling for 1 hour, the specimen was weighed and found to be 5.781 grams.

The specimen was cured in a manner similar to that described in Example 1. After curing, the specimen was weighed and found to be 5.623 grams. The resultant coated specimen contained a coating of $TiB_2$.

Resistance of the $TiB_2$ coated specimen to thermal oxidation was evaluated as described in Example 1. After 2 hours at 600 degrees C in air, the coated specimen retained 90% of its cured weight. Upon cutting the specimen in half, it was observed that the carbonaceous fiber below the surface of the coating were intact. The coated specimen was compared to a second, uncoated sample of the carbonaceous fiber cloth as in Example 1. The uncoated sample was completely ashed and could not be removed from the quartz tube for weighing.

EXAMPLE 3

A piece of carbonaceous fiber similar to that of Example 2 was coated with boron carbide and cured in the manner of Example 2 except that the coating mixture comprised 1 gram of boron carbide, 8 grams of Graphi-Coat 623 Activator, and 4 ml of boric acid/urea solution described in Example 1. After 2 hours at 600 degrees C in air the BC coated carbonaceous fiber retained 66% of its cured weight. The uncoated sample was completely ashed.

The structure is suitable for use as a furnace insulation.

EXAMPLE 4

A piece of knitted carbonaceous fiber, as in Example 2, was coated and cured as described in Example 1. Resistance of the coated carbonaceous fiber to thermal oxidation was measured as in Example 1 except that the sample was heated to 700 degrees C and held at 700 degrees C for 1 hour.

The coated sample retained 59% of its cured weight while the uncoated sample was completely oxidized leaving only ashes.

The fiber is suitable for use as electric motor windings.

EXAMPLE 5

A piece of cloth knitted (plain jersey) from tows (6K) of OPF was heat treated at a maximum temperature of 900 degrees C to form the carbonaceous fiber of the present invention. A 1.0 gram specimen of the carbonaceous fiber product, still in the form of a knitted fabric, was supplied to Ti-Coating of Texas, Inc., of Houston, Tex. The carbonaceous fiber specimen was coated with TiC using a chemical vapor deposition (CVD) process proprietary to Ti-Coating of Texas, Inc.

In the CVD process titanium and carbon vapors react at the surface of a substrate at 1050 degrees C to form a coating on the substrate. No special conditions are utilized to coat the carbonaceous fiber, it is treated at the conditions normally used for depositing a layer of TiC on industrial tools and parts. Such a coating of TiC, when applied to industrial tools and parts, is referred to by Ti-Coating of Texas, Inc. as TC-7.

Surprisingly, the CVD coating and process deposited a layer of TiC on every part of the knitted fabric specimen providing a uniform coating on every filament of every tow in the fabric structure of the specimen. The coated specimen was unexpectedly flexible, i.e., the coating was not so thick as to restrict the ability of the fabric to conform to irregular surfaces. Only 1 gram of weight was added to the fabric by the CVD process, so that the resultant coated specimen weighed 2 grams. Several coated specimens were prepared in this manner.

The coated specimens were evaluated as to their stability to thermal oxidation following the procedure of Example 1 and Example 4 with the following results:

| Oxidation Temp. (C.) | Initial Weight | Final Weight | % Initial Weight |
|---|---|---|---|
| 700 | 1.524 g | 1.344 g | 88 |
| 600 | 1.078 g | 0.919 g | 85 |

EXAMPLE 6

A piece of carbonaceous fiber knitted fabric (prepared at 700 degrees C) was de-knitted, i.e., the individual tows were removed from the knit structure. The tows were then opened with a Shirley opener and the open tows were mixed with a polyester binder in a Rando Webber to product a non-woven fabric or batting material containing 25% polyester binder and 75% carbonaceous fiber. The non-woven was further treated with heat to melt the polyester binder to impart greater integrity to the batting (known as bonding). The bonded non-woven mat was then needle punched to provide greater entangling of the batting's fibers thus providing greater integrity and strength to the non-woven fabric.

The bonded, needle-punched batting was cut into specimens of approximately 1 gram in weight, and these specimens were then heated, under a nitrogen atmosphere, to a temperature of 1000 degrees C. The specimens were supplied to Ti-Coating of Texas, Inc. of Houston, Tex. The specimens were coated with TiN using a chemical vapor deposition (CVD) process proprietary to Ti-Coating of Texas, Inc.

In the CVD process titanium and nitrogen vapors are reacted at 1050 degrees C on the surface of the target substrate. No special conditions are utilized to coat the carbonaceous fiber batting. The batting is treated at the conditions normally used for depositing a layer of TiN on industrial tools and parts. Such a coating of TiN, when applied to industrial tools and parts, is referred to by Ti-Coating of Texas, Inc. as TN-6.

The CVD coating process deposited a layer of TiN on every part of the batting, uniformly coating every filament of carbonaceous fiber in the batting structure. The coated specimen was very flexible. Coating of the specimens with TiN increased specimen weight by a factor of 2 to 3. Several specimens of TiN-coated batting were prepared in this manner.

A coated specimen was evaluated as to its stability to thermal oxidation following the procedure of Example 1. with the following result:

| Oxidation Temp. (C.) | Initial Weight | Final Weight | % Initial Weight |
|---|---|---|---|
| 600 | 1.16 g | 1.19 g | 100 |

What is claimed is:

1. An oxygen and thermally stable fiber or tow of fibers comprising a carbonaceous fiber or tow of fibers with a ceramic surface coating thereon, said carbonaceous fiber or tow of fibers comprising resilient shaped reforming elongatable non-linear non-flammable carbonaceous fiber or fibers, said fiber or fibers having a reversible deflection ratio of greater than 1.2:1 and an aspect ratio greater than 10:1.

2. The fiber or tow of fibers of claim 1 wherein the fiber or tow of fibers have a sinusoidal configuration.

3. The fiber or tow of fibers of claim 1 wherein the fiber or tow of fibers have a coil-like configuration.

4. The fiber or tow of fibers of claim 1 wherein the coating is selected from the group consisting of oxides, carbides, borides, nitrides, borates and silicates.

5. The fiber or tow of fibers of claim 1 wherein the fiber or tow of fibers are derived from oxidized polyacrylonitrile fibers.

6. The fiber or tow of fibers of claim 1 wherein the fiber or tow of fibers are derived from an acrylic based polymer.

7. The fiber or tow of fibers of claim 11 wherein the coating is selected from the group consisting of TiN, TiC, $TiB_2$, BN and BC.

8. The fiber or tow of fibers of claim 1 wherein said fiber or tow of fibers have a resistance of greater than $10^7$ ohms per inch when measured on a 6K tow formed from precursor fibers having a diameter of 7 to 20 microns and are non-electrically conductive fibers.

9. The fiber or tow of fibers of claim 1 wherein said fiber or tow of fibers have a resistance less than $10^4$ ohms per inch when measured on a 6K tow formed from precursor fibers having a diameter of 7 to 20 microns and are electrically conductive.

10. The fiber or tow of fibers of claim 1 wherein said fiber or tow of fibers have a resistance of about $10^7$ to $10^4$ ohms per inch when measured on a 6K tow formed from precursor fibers having a diameter of 7 to 20 microns and possess anti-static characteristics.

* * * * *